US005411283A

United States Patent [19]

Nowak et al.

[11] Patent Number: 5,411,283

[45] Date of Patent: May 2, 1995

[54] SAFETY SKI BINDING

[75] Inventors: Gerhard Nowak, Biedermannsdorf; Alfred Winter, Vienna; Rudolf Theurer, Trumau; Hans-Peter Morbitzer, Vienna; Klaus Kruschik, Gumpoldskirchen; Peter Wieser, Vienna, all of Austria

[73] Assignee: HTM Sport- und Freizeitgeraete Aktiengesellschaft, Schwechat, Austria

[21] Appl. No.: 50,149

[22] PCT Filed: Aug. 21, 1992

[86] PCT No.: PCT/EP92/01916

§ 371 Date: Jun. 25, 1993

§ 102(e) Date: Jun. 25, 1993

[87] PCT Pub. No.: WO93/03803

PCT Pub. Date: Mar. 4, 1993

[30] Foreign Application Priority Data

Aug. 23, 1991 [AT] Austria ..... 1664/91

[51] Int. Cl.[6] ..... A63C 9/08

[52] U.S. Cl. ..... 280/618; 280/612; 280/626; 280/634

[58] Field of Search ..... 280/611, 612, 623, 626, 280/618, 629, 628, 632, 634, 631, 633

[56] References Cited

U.S. PATENT DOCUMENTS 4,159,124 6/1979 Salomon ..... 280/612

4,880,252 11/1989 Nowak et al. ..... 280/618

FOREIGN PATENT DOCUMENTS 304329 4/1972 Austria .
319110 2/1974 Austria .
375833 2/1984 Austria .
386961 4/1988 Austria .
387909 9/1988 Austria .
388110 10/1988 Austria .
2907939 9/1979 Germany .

*Primary Examiner*—Richard M. Camby
*Attorney, Agent, or Firm*—Flynn, Thiel, Boutell & Tanis

[57] ABSTRACT

A safety ski binding comprising an electronic evaluating circuit which is connected to force-receiving means giving off electrical signals, an electrical current supply, for example a battery, and an electromechanical release member, which drives a control element which controls a locking mechanism engaging a movably supported sole-down-holding means, with the electromechanical release member being arranged at least with a part of the control element in a tightly closed housing of a control block, with the control element being designed as a shaft snugly guided through the wall of the housing. In order to assure in such a binding a high degree of insensitivity of the release characteristic with respect to accelerating forces acting onto the release mechanism, it is provided that the electromechanical release member is formed by an electric motor (105') which controls preferably through a gearing a locking system blocking or releasing the shaft (7) serving as the control element.

5 Claims, 11 Drawing Sheets

SAFETY SKI BINDING

FIELD OF THE INVENTION

The invention relates to a safety ski binding comprising an electronic evaluating circuit which is connected to a force-receiving means giving off electrical signals, an electrical current supply, for example a battery, and an electromechanical release member driving a control element, which latter controls a locking mechanism engaging a movably supported sole-down-holding means, and the electromechanical release member is arranged at least with one part of the control element in a tightly closed housing of a control block, and with the control element being designed as a shaft snugly guided through the wall of the housing.

BACKGROUND OF THE INVENTION

Such a safety ski binding became known from AT-PS 386 961 (corresponding to U.S. Pat. No. 4,880,252) and has been successful because the danger of an icing up of the sensitive release member is avoided by the tight shielding of the electromechanical release member. The known solution provides an electromagnet with a flap anchor as the electromechanical release member on which a locking system is supported, which, when the anchor has dropped off, holds the control element in its rest position so that also the locking mechanism of the jaw can be held in its locked position.

SUMMARY OF THE INVENTION

The goal of the invention is to provide an improved safety ski binding of the abovementioned type such that it is distinguished by a high degree of insensitivity of its release characteristic with respect to the accelerating forces occurring during skiing and acting on the release mechanism, or rather that these forces do not influence the release behavior of the ski binding.

This is achieved according to the invention by the electromechanical release member being an electric motor which controls—preferably through a gearing—a locking system blocking and releasing the shaft serving as the control element.

These measures result in the advantage that accelerating forces can have practically no influence on the release of the jaw since the motor, as soon as it is supplied with voltage through the evaluating circuit, starts to rotate and initiates the release. A reaction by the accelerating forces which act onto the individual parts of the locking system and the motor stays within practically negligible limits, in particular when the motor controls the locking system through a gearing. This results in a release characteristic of the safety ski binding which is practically independent from the accelerating forces acting onto the release mechanism.

AT-PS 319 110 already discloses a safety ski binding in which the release member is an electric motor, however, the motor in this known solution acts through a cable line directly onto the locking member. The motor and the cable line are thereby arranged practically unprotected in the housing of the jaw. Furthermore, the motor must produce the entire release force and must therefore be of a suitable size and, in addition, the danger of icing up, in particular an icing up of the cable line, must also be taken into consideration so that in the known case a corresponding demand for current for the motor exists.

In the solution of the invention, the motor is arranged in a tight housing of a control block and acts onto the locking system which in turn blocks or releases the locking mechanism and can be designed, for example, according to AT-PS 388 110 or AT-PS 387 909, so that the motor need only produce small control forces and can therefore be very small and use only little electrical energy. Thus a small battery is sufficient.

A further characteristic of the invention provides that the locking system is a gear mating with a pinion driven by the electric motor and being connected fixed against rotation to a crank, to which a pull rod is hinged. The pull rod is hingedly connected to a pivotally held lever which, in the locked position, supports the shaft serving as the control element against the force applied by the locking mechanism of the jaw.

A structurally very simple solution requiring only very few individual parts results in this manner. Furthermore, very simply formed and simply manufacturable individual parts result. Moreover the advantage of a direct cooperation of the individual parts with one another exists. Also the great temperature variations, which must be considered during skiing, have practically hardly any influence on the cooperation of the individual parts, in contrast to a cable line.

It can thereby furthermore be provided that in the locking position of the locking system the crank and the pull rod, which together form the toggle-lever system, are in an over-dead-center position and are supported, preferably in their connecting area, on a stop.

This measure achieves a particularly high degree of insensitivity with respect to the accelerating forces since forces acting in the locked state of the locking system through the pull rod can merely be introduced into the stop and can have no effect on the gear and the motor.

Furthermore it can be provided that the gear is initially tensioned by means of a spring, preferably a coil spring, against its position corresponding with the locked position.

With this it is assured in a simple manner that the locking system is initially tensioned against its locked position and therefore assumes this position during the normal operation of the binding.

Furthermore it can be provided that the lever controls a switch designed as a changer which selectively connects the electric motor to the voltage supply, or rather the evaluating circuit or separates same therefrom and short-circuits same, the latter occurring as soon as the lever is in a position releasing the control element.

By short-circuiting the motor, it is achieved that same can be quickly stopped and that the lever or other parts of the locking system will not strike the housing. The short-circuited motor is then turned back into its initial position by the spring engaging the gear thereby also permitting the entire locking system to again assume its locking position. Furthermore, a control of the motor in the open position of the jaw, which can be triggered by force actions onto the binding, is safely avoided, thus avoiding an unnecessary load on the battery of the binding.

Furthermore it can be provided that the gear can be operated by means of a manually operable release rod which extends through the wall of the housing of the control block, if necessary directly through a rope fixed to the gear and on the housing, in the sense of a release of the locking system.

These measures result in a release mechanism which is very simple in structure and which permits an arbitrary manual release of the jaw.

BRIEF DESCRIPTION OF THE DRAWINGS

The invention will now be discussed in greater detail in connection with the drawings, in which.

DETAILED DESCRIPTION

Figure 1:
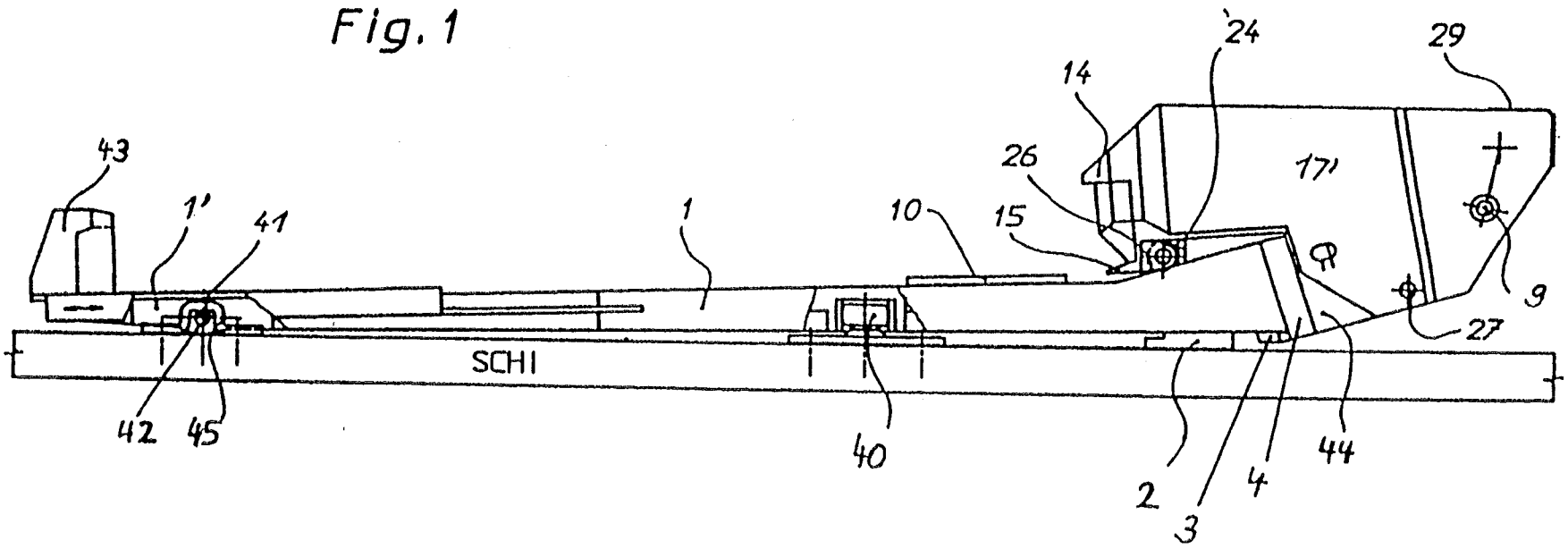
FIG. 1 schematically illustrates the design of a ski binding.

The binding illustrated in FIG. 1 is constructed as a plate binding, with the binding plate 1 being rotatable around a spherically designed pin 40 arranged in the area of the point of intersection between the axis of the tibia of the skier and the plane of the ski and makes possible a rotation of the binding plate 1 in the plane of the ski. The binding plate 1 has in its front area an axle 41 extending through a slot 42 of a ski-fixed arranged mounting 45, which slot 42 extends in a longitudinal direction of the ski. The mounting 45 projects with an all around large play into a recess 1' provided on the underside of the binding plate 1, thus making possible a limited rotation of the binding plate about the pin 40 and a upward pivoting of the binding plate 1 about the axle 41.

Furthermore a strong, not releasable toe jaw 43 is held adjustably and lockably in longitudinal direction of the binding plate 1 in the front area of said binding plate.

A releasable heel jaw 17' arranged at the rear area of the binding plate 1 is connected to the binding plate 1, with its sole-down-holding means 17 being upwardly pivotal about an axle 9. The binding plate 1 is furthermore fixedly connected at its rear area to a control block 44 which is supported by force-receiving means 4 and a measuring element 3. The measuring element 3 engages through an essentially spherically constructed end 3' a ski-fixed abutment 2.

The binding plate 1 is in this manner essentially fixed in its position, however, a movement of the binding plate 1 in the degree of the measuring paths of the force-receiving means 4 is possible, which paths, based on the fixed fulcrum points of the binding plate 1 about the pin 40 and the axis 41, make it possible to detect the moments ±Mz and ±My acting onto the binding plate 1.

Figure 5:
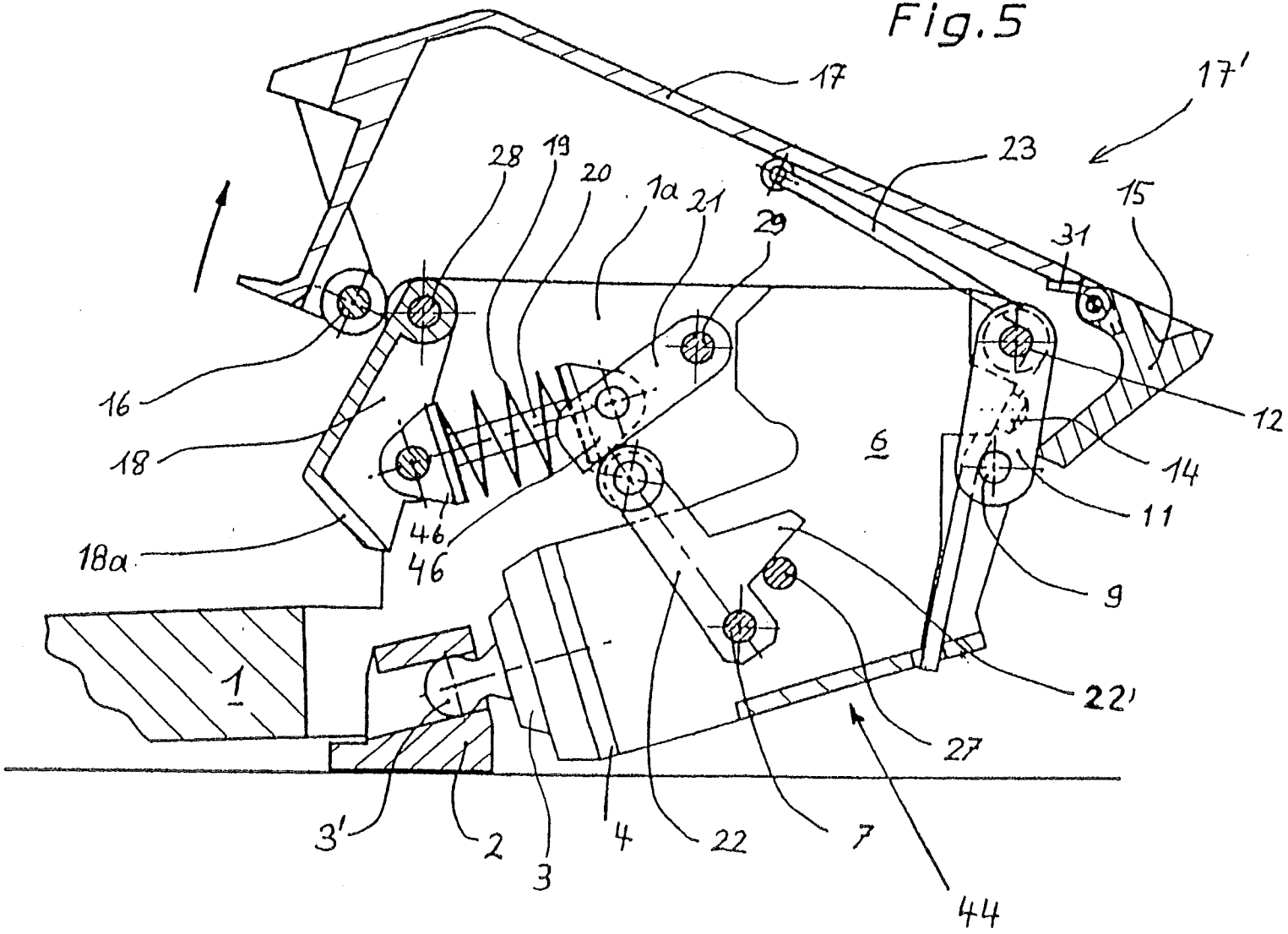
FIG. 5 schematically illustrates a heel jaw after the release of the ski boot.

The heel jaw 17' has a common opening spring 23 for its sole-down-holding means 17, which opening spring 23 is supported on the binding plate 1 and on the sole-down-holding means 17 and initially tensions same in direction of its upwardly pivoted end position illustrated in FIG. 5.

The essentially cap-shaped sole-down-holding means 17 has a nose projecting toward its inside, on which nose is rotatably held a locking roller 16 over which grips in the locked position of the binding an arm 18 having a locking surface 18*a* thereon. The arm 18 is pivotally supported on a rotation axle 28, which in turn is fixed in an upstanding fork-shaped extension 1*a* of the binding plate 1. A coupling bar 20 is hinged through supports 46 for a tensioning spring 19 to the arm 18 and to an outer support lever 21 for connecting the arm 18 to the lever 21. The lever 21 is pivotally supported about a further rotation axle 29 rigidly connected to the fork-shaped extension 1*a* of the binding plate 1. The coupling bar 20 is supported for movement in its longitudinal direction and with a greater play in the supports 46 of the tensioning spring 19.

The tensioning spring 19 acts between the parts connected with one another through the coupling bar 20 urging the two parts apart. The arm 18 is in this manner pressed against the locking roller 16 with the outer support lever 21 being supported thus hindering the sole-down-holding means 17 from pivoting upwardly.

A manually operable release head 15 is pivotally supported about an axle 30 in the heel jaw 17', with this release head 15 being initially tensioned against its inactive position by means of a spring 31. When the release head 15 is depressed, it pivots clockwise or rather against the force of the spring 31 and presses into engagement with a release pin 14 held in a through guide of the housing 6 of the control block 44 enclosing a release mechanism and is initially tensioned against its inactive position illustrated in FIGS. 2 to 5 by means of a spring 119. This release pin 14 is sealed off against the housing 6, for example, by means of an O-ring, however, it is also possible to seal off the release pin 14 by means of a membrane stretched over the free end of the release pin 14 or is designed as part of the housing and on which the release head 15 can rest.

The measuring element 3 is supported with its spherical end 3' on the ski-fixed abutment 2. This measuring element 3 has those force-receiving means 4 which detect the moments ±My and ±Mz acting on the binding plate 1 around its axes of rotation and convert same into electrical signals. These force-receiving means 4, which can optionally be designed, for example, as piezoelectrical converters or as wire strain gauges, are connected to the housing 6 of the control block 44. A battery, an evaluating circuit, and an electromechanical release and parts of a mechanical locking system of the binding are housed in a conventional manner in this control block 44.

The inner design of the control block 44 itself, which is the subject matter of the invention, will be discussed later.

The release mechanism in the control block 44 is rotationally fixedly connected to an outer locking arm 22 through a shaft 7 snugly guided through its housing, which locking arm 22, for reasons of a design with little friction, is constructed as a roller lever. This outer locking arm 22 supports—viewed in the state of the binding in which it is ready for operation—the outer support lever 21 pivotally held on the rotation axle 29 rigidly connected to the binding plate 1. The outer support lever 21 serves as an abutment for the tensioning spring 19 which, as has already been discussed, presses the arm 18 carrying the locking surface 18*a* against the locking roller 16 of the heel jaw 17.

Figure 2:
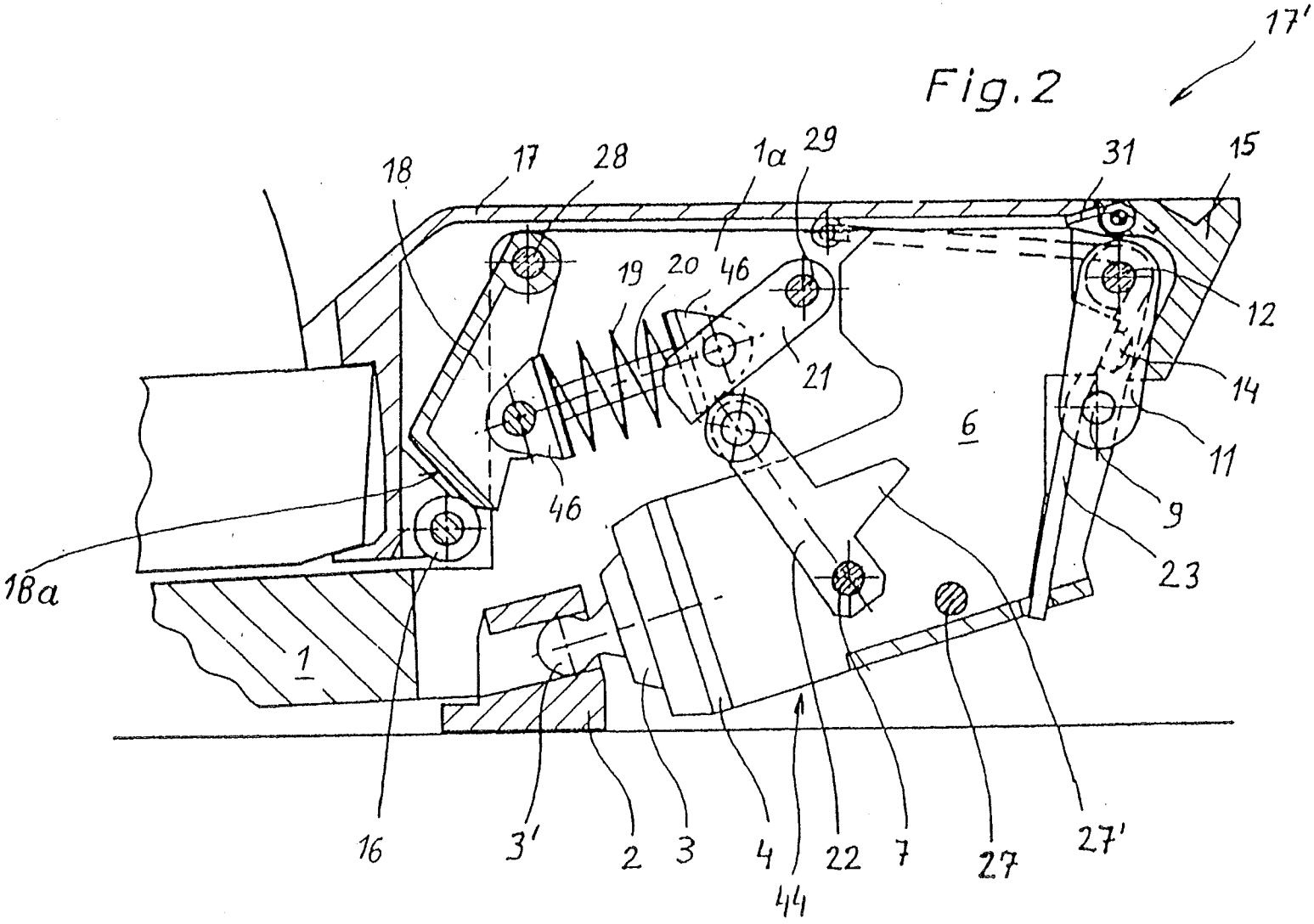
FIG. 2 schematically illustrates a heel jaw in the operating position.

As can be seen from FIG. 2, the outer support lever 21 is supported on the outer locking arm 22 such that the outer support lever 21 defines an angle with the outer locking arm 22, which angle slightly exceeds 90°, in order to apply a torque onto the outer locking arm 22, which torque initially tensions the locking arm 22 toward its unlocking position. The release mechanism absorbs this torque and is thus initially tensioned toward its unlocked position. The torque acting onto the outer locking arm 22 supports thereby a possible release so that such a release is hardly hindered by an accumulation of ice and a release is possible with small forces applied by the release mechanism.

By swinging the sole-down-holding means 17 upwardly after a release occurred arbitrarily or automatically, as can be seen in FIG. 5, a shoulder 27 on the sole-down-holding means rests on the shoulder 22′ of the outer locking arm 22 and returns same into its operating position. This turning back of the outer locking arm 22 causes through the shaft 7 also a return of the release mechanism.

This turning back requires only little force since the tensioning spring 19 acts thereby only onto the parts 18, 21 connected by means of the coupling bar 20 and forms with these a closed system. During a subsequent pressing down of the sole-down-holding means 17, its locking roller 16 presses on the arm 18 with the locking surface 18*a* such that the tensioning spring 19 is compressed. The sole-down-holding means 17 is thus again locked.

FIGS. 2 to 5 show that the deflection of the sole-down-holding means 17 on the essentially ski-fixed held plate 1 occurs through a plate arrangement consisting, for example, of a pair of plates 11, which arrangement is supported on two axles which, in the operating position of the heel jaw 17′, extend transversely with respect to the ski and parallel with respect to its upper surface, namely the already mentioned axle 9 to which the cap-shaped sole-down-holding means 17 is hinged, and the axle 12 which is held in the binding plate 1 or its upstanding fork-shaped extension 1*a*. Thus, the sole-down-holding means 17 is connected only through the plates 11 to the binding plate 1 held on the ski. The sole-down-holding means 17 is thereby locked to the binding plate 1 through the arm 18 carrying the locking surface 18*a*, which arm is pivotally supported on the plate 1 or its upstanding fork-shaped extension 1*a*, and through the locking roller 16 rotatably supported on the sole-down-holding means 17 grips the locking surface 18*a* in the operating position of the sole-down-holding means 17.

By connecting the binding plate 1 to the sole-down-holding means 17 through the plates 11, a deposit of snow on the sole of the boot or changes in the length of same based on its hygroscopical characteristics has hardly any effect on the release characteristic of the binding, since these changes can be largely compensated for by a resulting change of the position of the plates and an influencing of the release characteristic therefore does practically not take place, as this is discussed in AT-PS 387 909.

Figure 3:
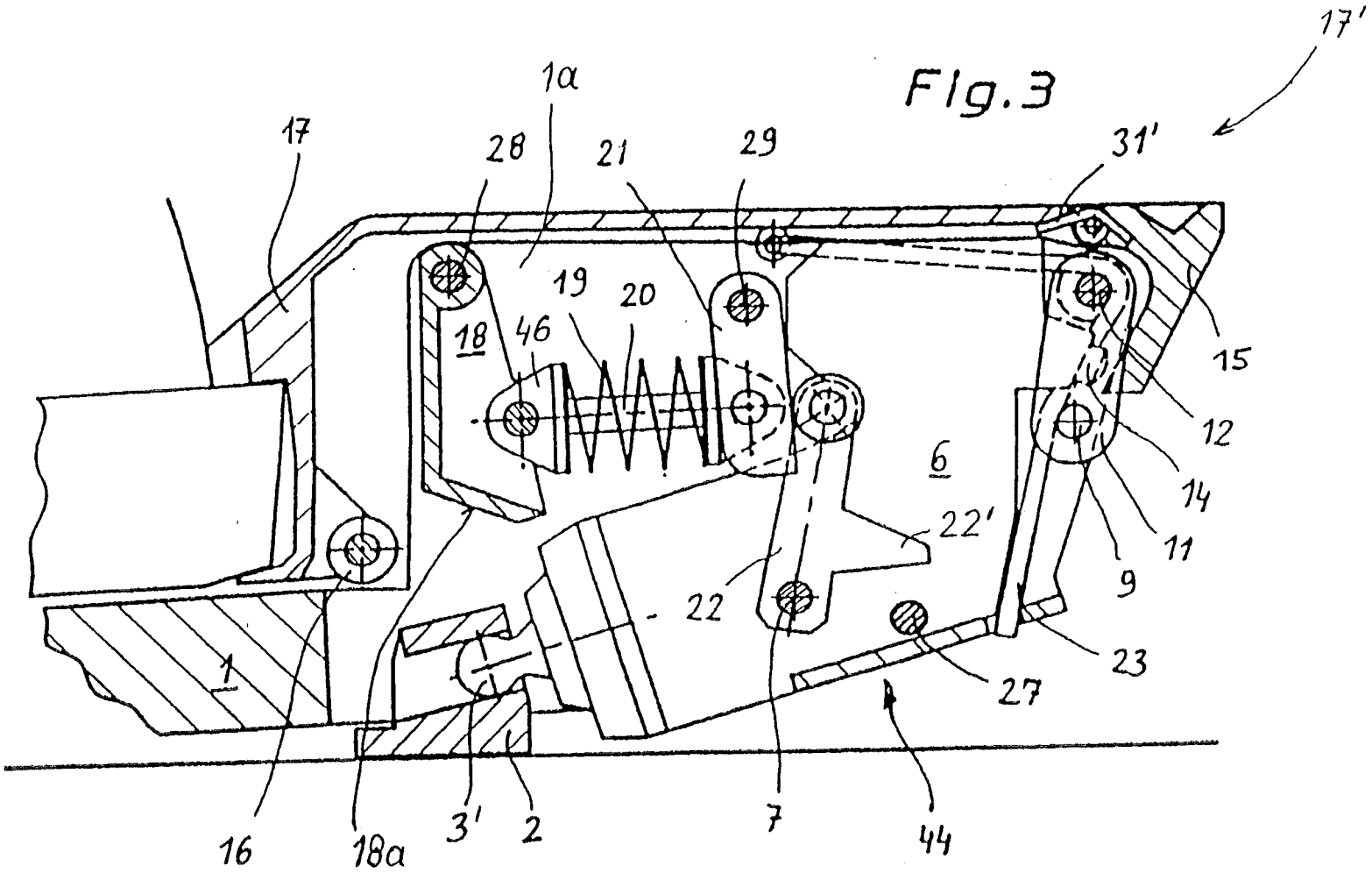
FIG. 3 illustrates the heel jaw according to FIG. 2 in the released state.
Figure 4A:
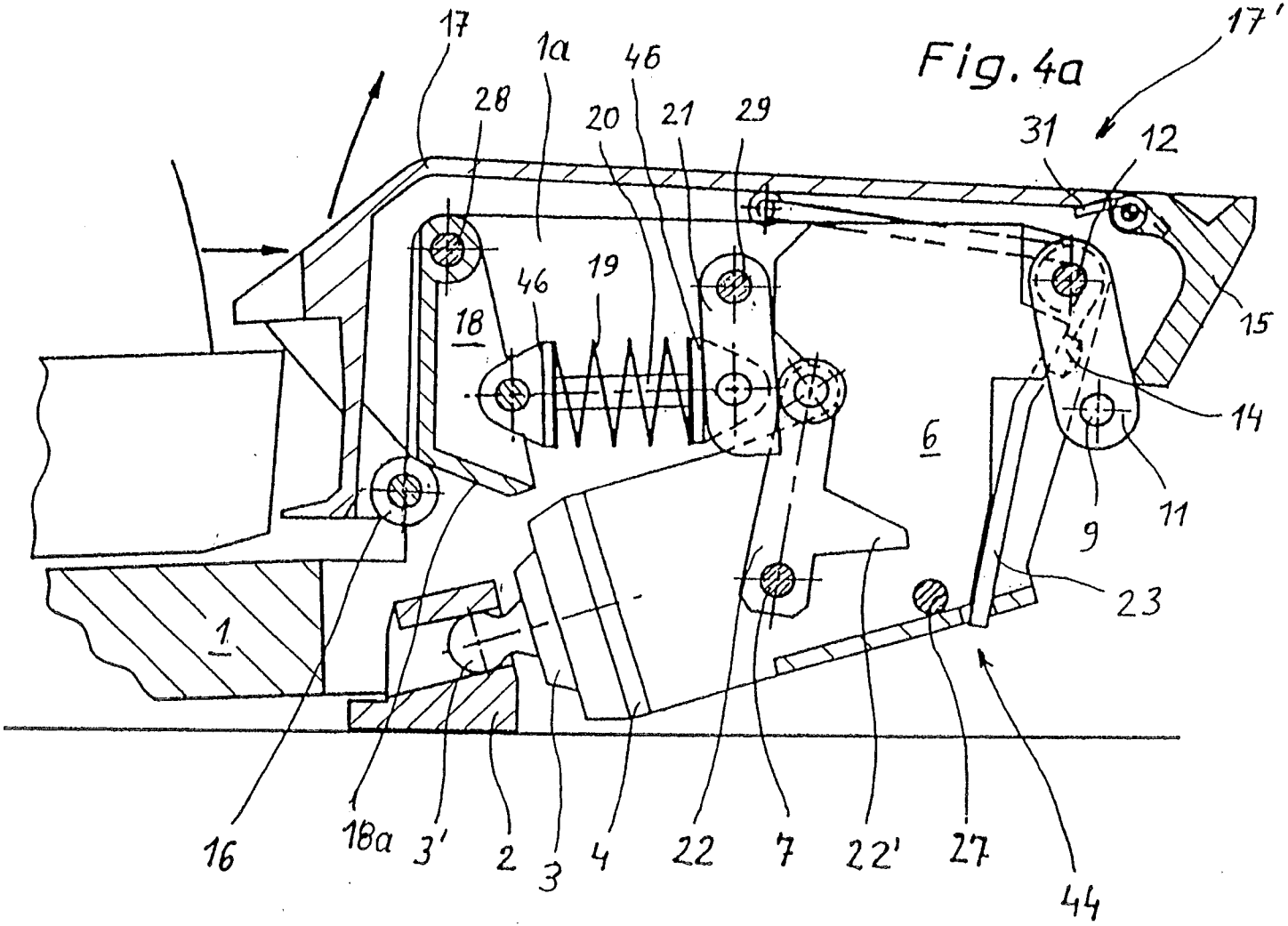
FIGS. 4*a* and 4*b* illustrate the released heel jaw according to FIG. 3 during various phases of turning out and lifting off of the heel area of the ski boot.
Figure 4B:
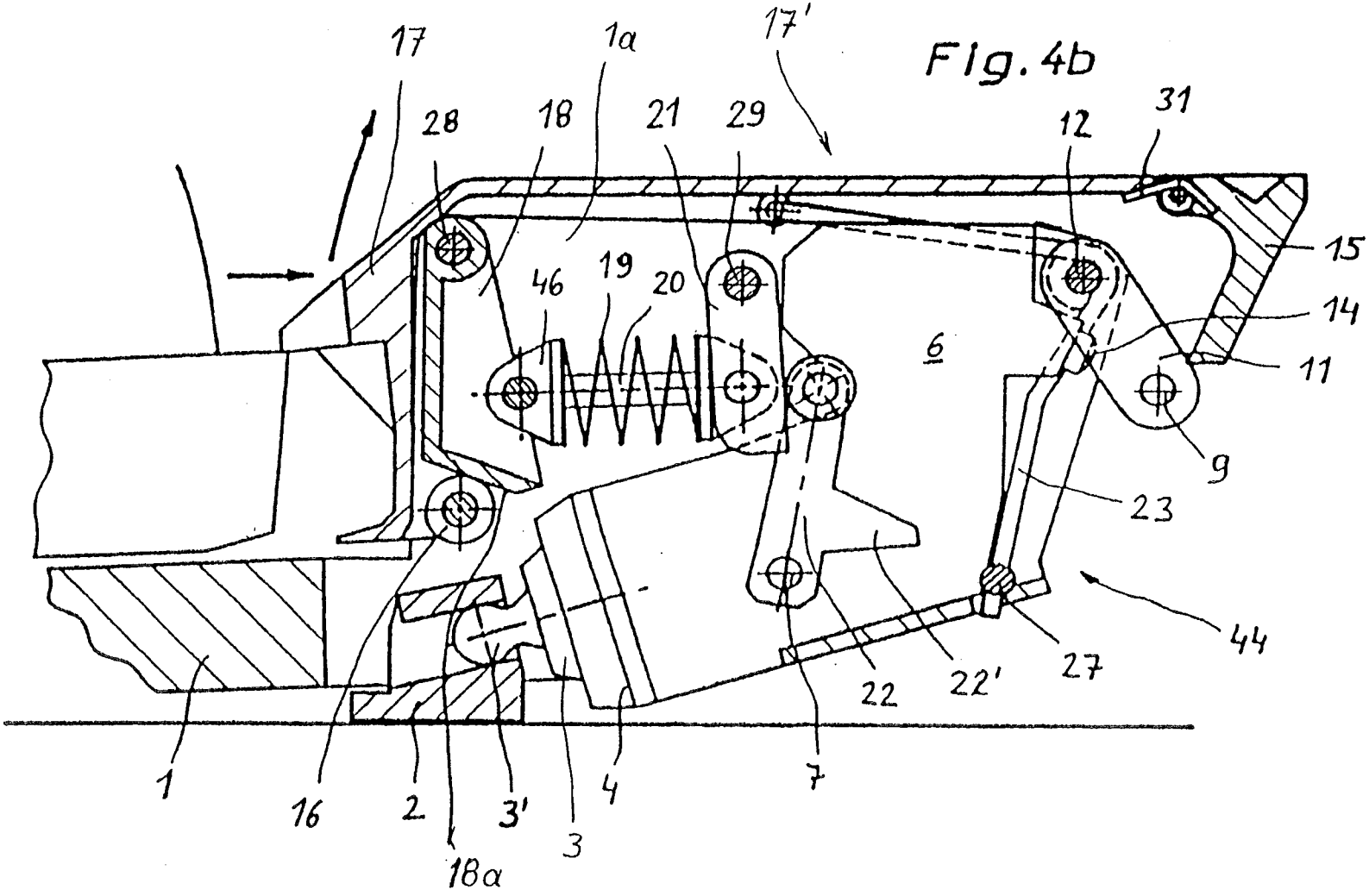

FIG. 3 shows the heel jaw 17′ during the moment of the release of the control block 44 of the invention. The locking arm 22 has thereby already left its position supporting the support lever 21, because of a lack of a moment holding same in its supporting position, produced by the release mechanism inside of the housing 6 of the control block 44 in its locking position and by the moment applied on the locking arm 22 by the support lever 21 and acting in direction of the release position, and has reached its release position. The tensioning spring 19 has with this, however, lost its abutment consisting of the parts 21, 22. The tensioning spring 19 together with the arm 18 and the support lever 22 now forms a closed system which no longer applies any forces in outward direction. With this it is possible, also in the case of small forces applied by the boot onto the sole-down-holding means 17, to move the sole-down-holding means rearwardly, as this is shown in FIGS. 4*a* and 4*b*, thus causing a yielding of the plates 11. Furthermore, the sole-down-holding means 17 can also be pivoted upwardly without any significant force, with the latter being additionally supported by the opening spring 31.

FIG. 5 shows the heel jaw with the sole-down-holding means 17 being swung upwardly after a release, with the locking arm 22 and thus the release mechanism, as this has already mentioned, being returned in the control block 44 by the upward swing of the sole-down-holding means 17. This is done with the help of the shoulder 27 arranged on the sole-down-holding means 17, which shoulder 27 rests on the shoulder 22′ of the locking arm 22 and takes same along.

Figure 6A:
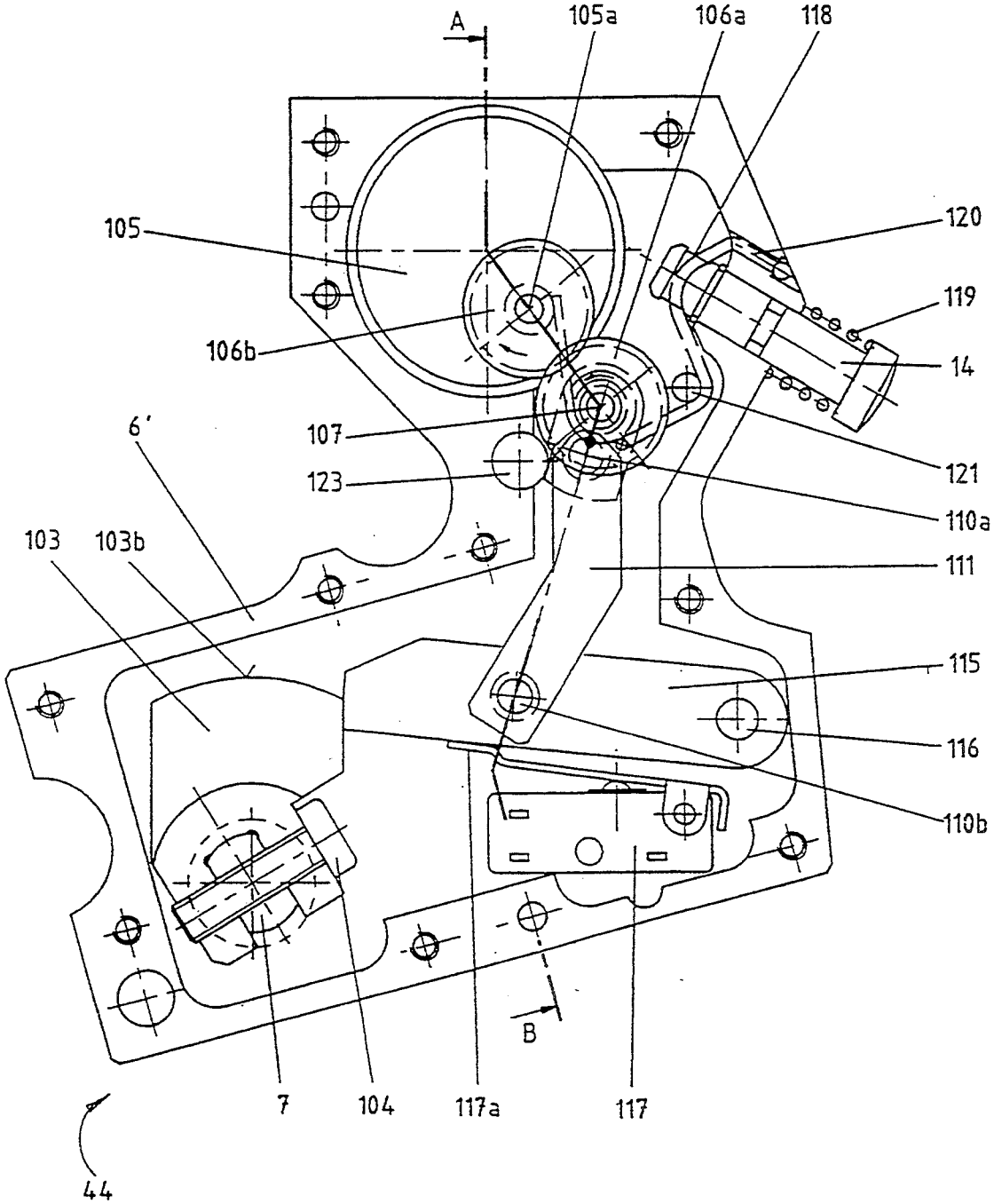
FIGS. 6*a* and 6*b* illustrate a control block of the invention with an open housing in the operating position and in the released position.
Figure 6B:
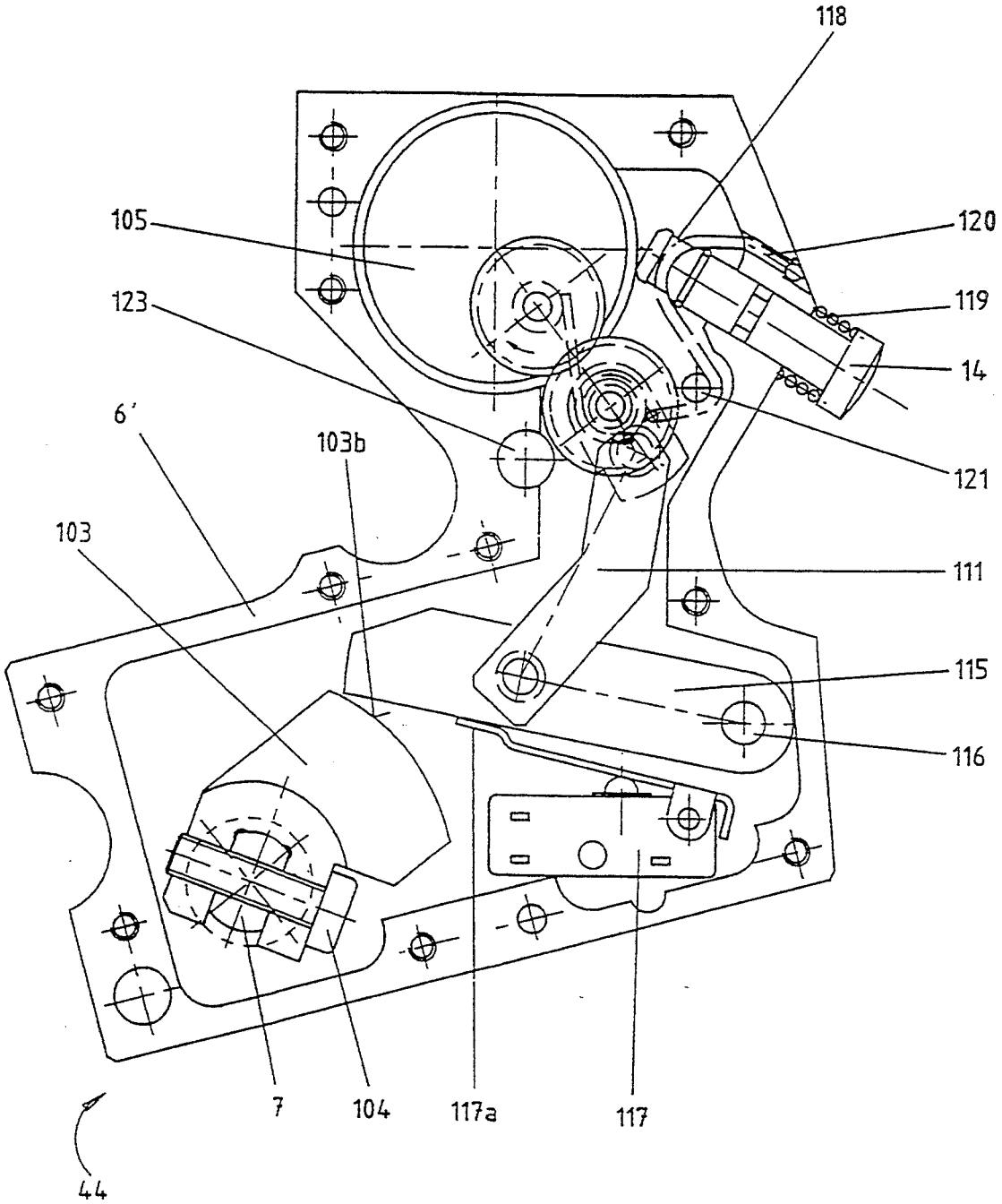
Figure 7:
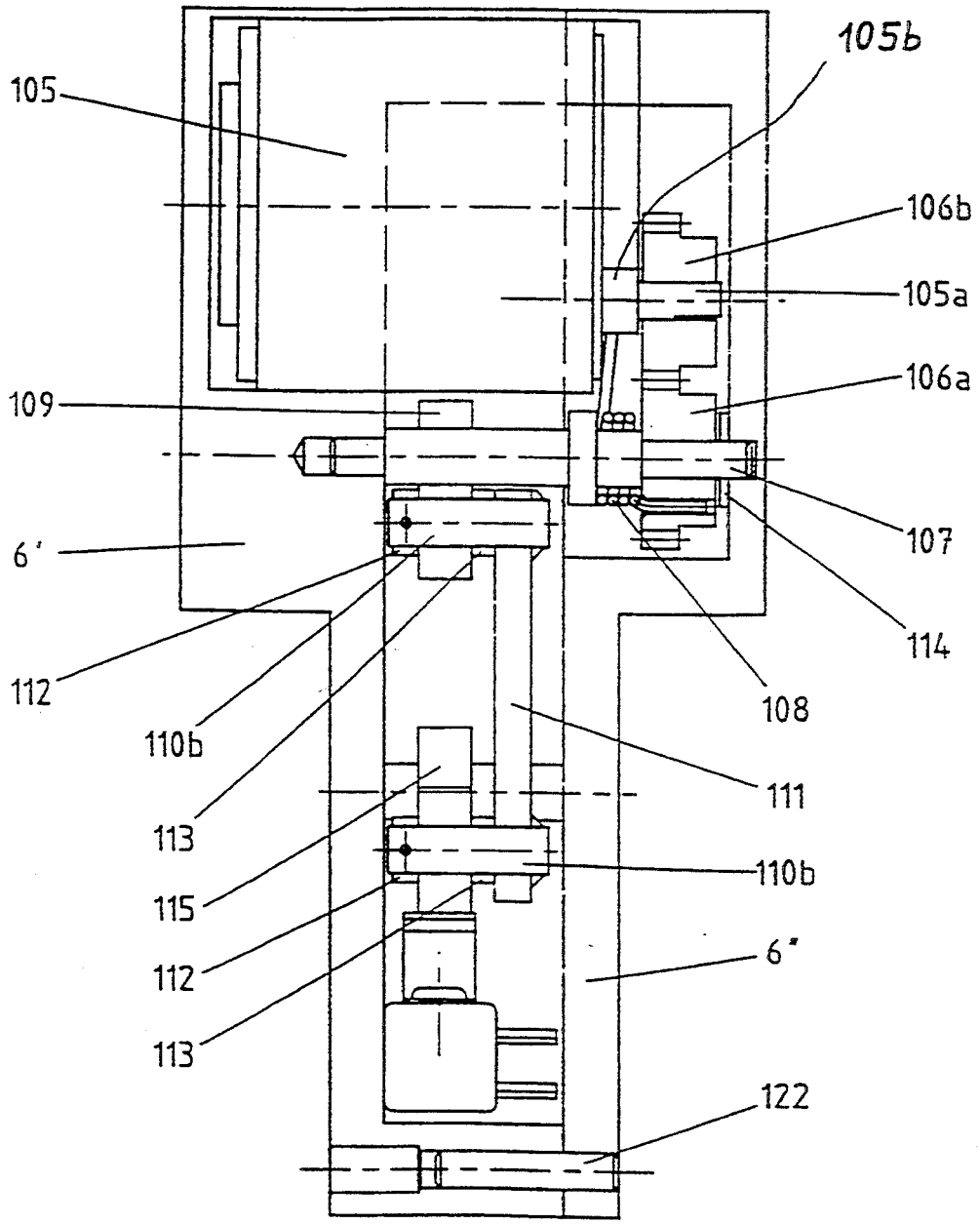
FIG. 7 is a cross-sectional view along the lines A–B of FIG. 6*a*.
Figure 8:
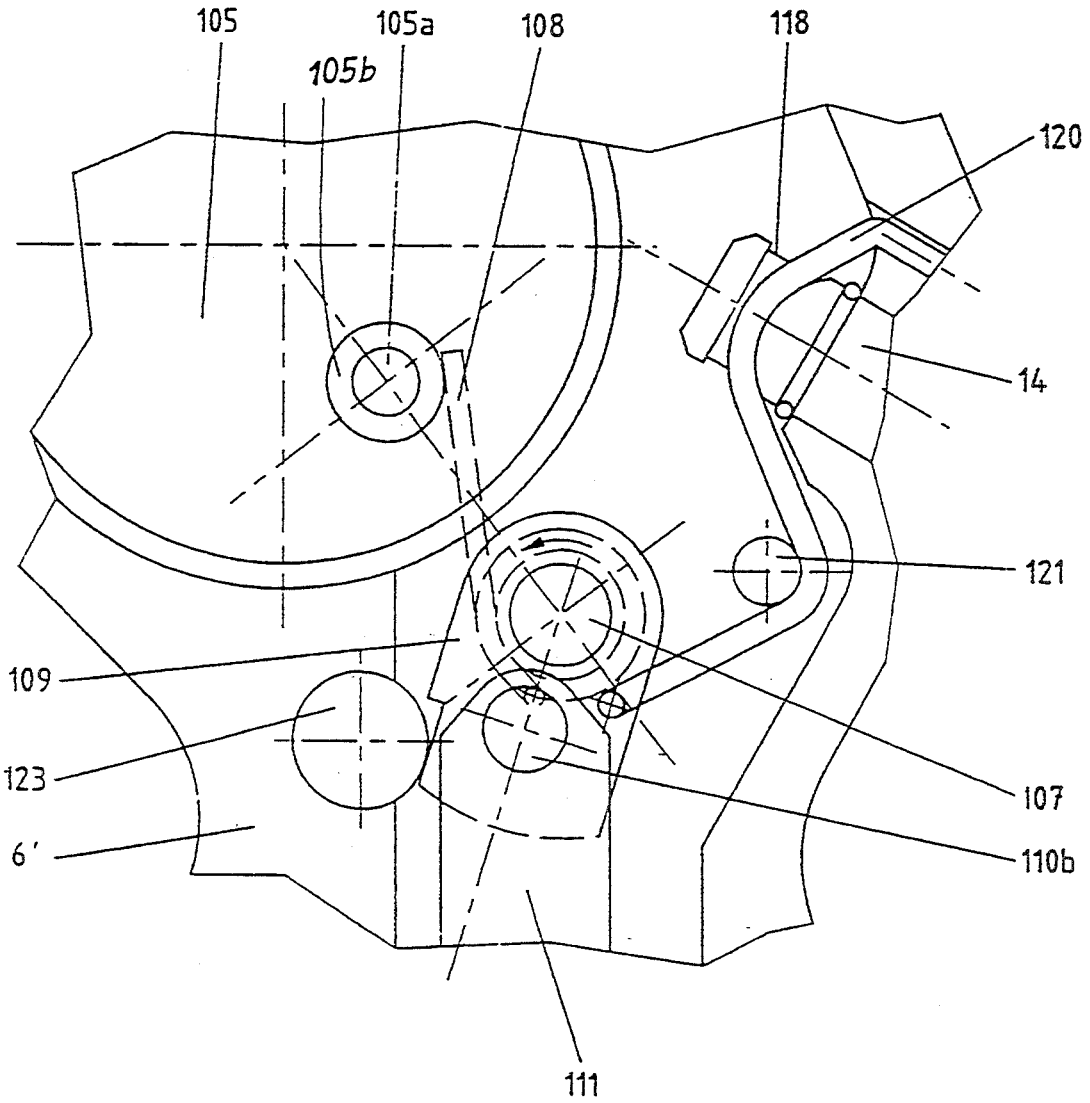
FIG. 8 illustrates in an enlarged scale a detail of the control block of the invention according to FIGS. 6*a* and 6*b*, and FIG. 9 schematically illustrates the control circuit for the motor.

The control block 44 has, as can be seen in FIGS. 6*a* and 6*b*, two housing halves 6′ and 6″ which are closely connected with one another and form the housing 6 and which encloses the release member and the locking system according to the invention.

The release member of the control block 44 of the invention is an electric motor which is combined with a step-down gear to a geared motor 105, with a pinion 106*b* being rotationally supported fixedly on its driven shaft 105*a*, which pinion is part of the locking system.

The pinion 106*b* mates with a gear 106*a* which is connected fixed against rotation to a crank 109 through a shaft 107, which is held in blind holes of the two housing halves 6′, 6″. A torsion spring 108 is furthermore moved onto this shaft 107, one end of which torsion spring engages the gear 106*a* and a second, tangentially projecting end of which torsion spring rests on a shoulder 105*b* of the housing of the geared motor 105, which shoulder 105*b* guides the driven shaft 105*a* of the geared motor 105. The torsion spring 108 initially tensions thereby the gear 106*a* toward a locked position of the locking system, part of which also includes the gear 106*a* and the crank 109, and also a pull rod 111, a lever 115 connected to the pull rod, and a cam member 103 cooperating with the lever and held fixed against rotation on the shaft 7, is possible.

The crank 109 is hingedly connected to the pull rod 111. The pull rod 111 has at its two ends laterally projecting axle journals 110*b* thereat received at one end in a bore on the crank 109 and at the other end in a bore on the lever 115. Sleeves 112 are moved onto the free ends of the axle journals 110*b* to secure the pull rod 111, which sleeves 112 are secured by pins 130 in their axial position. Washers 113 are furthermore placed between the pull rod 111 and the crank 109, and the lever 115.

The lever 115 is pivotally supported on a housing-fixed axle 116 and has at its free end a sloped surface which serves as an end stop which can rest on the inner wall of the housing 6.

The free end surface of the lever 115 serves as a stop for the cam member 103 held fixed against rotation on the shaft 7, which cam member 103 grips forklike around the shaft 7 with symmetrical flat areas and is secured thereto by a screw 104.

Figure 9:
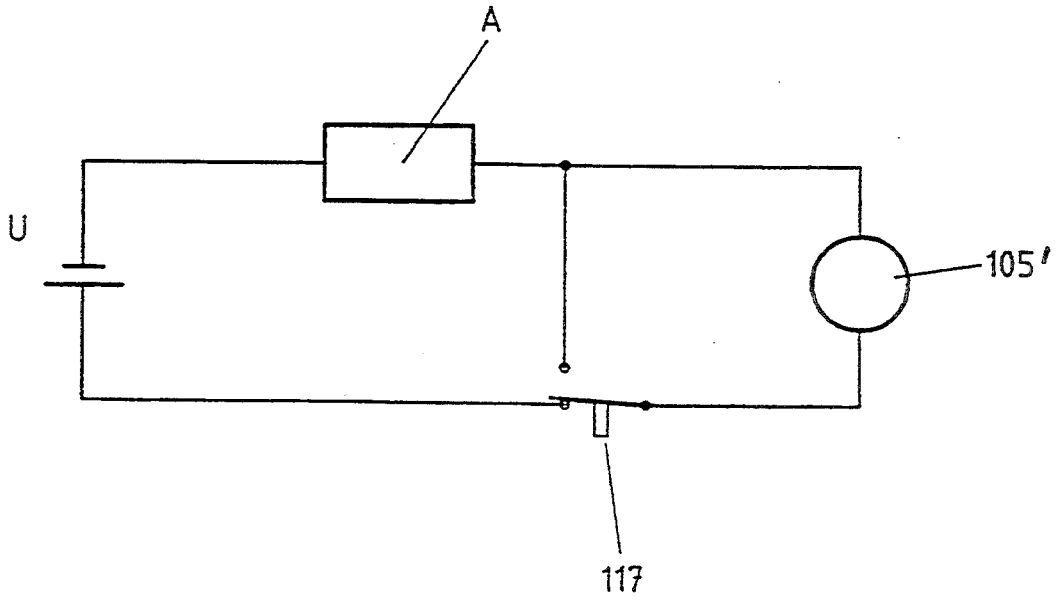

The lever 115 cooperates furthermore with a control arm 117*a* of a switch 117 which is designed as a changer end, as is shown in FIG. 9, selectively connects the electric motor 105' to a current source U or a short-circuit. The latter is the case when the lever 115 is swung upwardly and releases the shaft 7 loaded in a clockwise direction by the support lever 21 or the cam member 103 connected fixed against rotation to the shaft, thus causing the jaw to be released and the boot to be set free.

Furthermore a rope 120 is secured at one end to the gear 106*a*, which rope is guided over an axle 121 serving as a guide means and the release pin 14 and is fastened at its second end in the housing 6. The rope lies thereby in a slot 118 in the release pin 14.

If the release pin 14 is now pressed inwardly against the force of the spring 119, then the gear 106*a* is rotated counterclockwise. The electric motor 105' is thereby connected to the evaluating circuit A and a current source U by the switch 117 so that the geared motor 105 can be easily rotated since the electric motor 105' is not short-circuited. A short-circuiting of the electric motor 105' can only take place when the lever 115 is raised. The gear 106*a*, which is locked against movement to the lever 115 through the pull rod 111 and the crank 109, is in this case, however, also in a position in which it can no longer be influenced by the release pin 14.

By rotating the gear 106*a*, the toggle-lever system formed by the crank 109 and the pull rod 111 and supported in the area of the connection of these two parts on a stop 123 is moved out of its over-dead-center position and the pull rod 111 is thereby lifted so that the lever 115 is also pivoted upwardly and the cam member 103, which is loaded through the shaft 7 with a torque acting in clockwise direction by the support lever 21, is thereby released thus causing the jaw to be released and the sole-down-holding means 17 to be pivoted upwardly.

As soon as the lever 115 is swung upwardly so far that the cam member 103 is released, the switch 117 switches over causing the electric motor 105' as shown in FIG. 9, to be separated from the current source U and at the same time short-circuited and thus stopped. The path of the release pin 14 is thereby dimensioned such that the lever 115 cannot hit the inner wall of the housing 6.

After the release pin 14 has been released, the spring 108 turns back the gear 106*a* and thus also the electric motor 105'. The torque produced by the torsion spring 108 is thereby greater than the braking moment of the electric motor 105' together with its gearing.

The lever 115 rests thereby, as can be seen in FIG. 6*b*, on the cam surface 103*b* of the cam member 103. As soon as the now upward pivoting of the sole-down-holding means 17 has ended, this, as shown in FIG. 5, also includes the return of the locking arm 22 and thus also of the cam member 103 which is connected fixed against rotation through the shaft 7 to the locking arm 22, the lever 115 returns into its rest position illustrated in FIG. 6*a*, with this movement having been forced by the spring 108, which also drives the toggle-lever system consisting of the crank 109 and the pull rod 111 into its over-dead-center position. This assures a high degree of insensitivity with respect to the accelerating forces acting onto the individual parts.

When the binding is released due to forces which are too high and thus act also onto the foot of the skier, the electric motor 105' is controlled by the evaluating circuit A and rotates the pinion 106*b* counterclockwise causing the gear 106*a* to be rotated clockwise and the release of the binding in the earlier described manner like during a manual release through the release pin 14. The braking of the electric motor 105' causes, due to its short-circuiting through the switch 117 after the release of the cam member 103, the further movement of the electric motor 105' and thus of the entire locking system in a release direction to end quickly and the lever 115 does not strike the inner side of the housing 6.

The geared motor 105 is also in this case turned back through the spring 108, with the switch 117 being pressed down upon the return of the lever 115 into its rest position (FIG. 6*a*) and the contact of the switch, which contact is designed as a changer, cancelling the short-circuit of the electric motor 105' and connecting same to the current source U.

The two housing halves 6', 6'' are tightly glued together along their interfacing surfaces with the correct position of the two halves 6', 6'' being assured by the fitting pins 122.

The embodiments of the invention in which an exclusive property or privilege is claimed are defined as follows:

1. A safety ski binding, comprising a movably supported sole-down-holding means, an electronic evaluating circuit and an electric motor connected in circuit therewith, a force-receiving means giving off electrical signals in response to relative movement between said safety ski binding and a ski on which said safety ski binding is mounted, an electrical current supply connected in electrical circuit with said electric motor, a control element movable between a first position locking said sole-down-holding means in a skiing position and a second position releasing said sole-down-holding means, a locking system for controlling the movement of said control element, and a locking mechanism coupled to said movably supported sole-down-holding means, said electric motor being arranged in a tightly closed housing of a control block, said electric motor having a driven output shaft sealingly guided through a wall of the housing and connected to said locking system, said locking system including a gear matingly coupled with a pinion coupled to said output shaft of said electric motor, said gear including a crank arranged eccentrically of said gear, a pull rod pivotally coupled to said crank at one end thereof and which is hingedly connected to a pivotally supported lever at another end thereof, said lever blocking in said first position of said control element movement of said control element in a direction towards said second position of said control element to thereby support the forces applied by said locking mechanism of said sole-down-holding means.

2. The safety ski binding according to claim 1, wherein said gear is urged to an initial position by means of a spring, said initial position corresponding with said first position of said control element.

3. The safety ski binding according to claim 1, wherein said lever controls a switch, said switch selectively connecting said electric motor to said electrical current supply and said evaluating circuit or separates same therefrom and short-circuits same, the latter occurring as soon as said lever is in a position releasing said control element for movement toward said second position.

4. The safety ski binding according to claim 1, including a manually operable release rod extending through the wall of said housing of said control block directly through a rope secured on said gear and on said housing and for effecting a release of said locking system.

5. The safety ski binding according to claim 1, wherein, in the locked position of said locking system, said crank and said pull rod, which together form a toggle-lever system, are in an over-dead-center position and are supported at their mutually connected end on a stop.

* * * * *